US010711379B2

(12) United States Patent
Nelson et al.

(10) Patent No.: US 10,711,379 B2
(45) Date of Patent: Jul. 14, 2020

(54) EMBROIDERY WORKPIECE HOLDING DEVICE

(71) Applicants: Chelsea Nelson, Stow, OH (US); Brandon Nelson, Stow, OH (US)

(72) Inventors: Chelsea Nelson, Stow, OH (US); Brandon Nelson, Stow, OH (US)

( * ) Notice: Subject to any disclaimer, the term of this patent is extended or adjusted under 35 U.S.C. 154(b) by 81 days.

(21) Appl. No.: 16/017,061

(22) Filed: Jun. 25, 2018

(65) Prior Publication Data

US 2019/0017204 A1 Jan. 17, 2019

Related U.S. Application Data

(60) Provisional application No. 62/531,010, filed on Jul. 11, 2017.

(51) Int. Cl.

| | |
|---|---|
| ***D05C 1/04*** | (2006.01) |
| ***D06C 3/08*** | (2006.01) |
| *D05C 9/10* | (2006.01) |

(52) U.S. Cl.

CPC ..... *D05C 1/04* (2013.01); *D06C 3/08* (2013.01); *D05C 9/10* (2013.01)

(58) Field of Classification Search

CPC ... D05C 1/00; D05C 1/04; D05C 9/00; D05C 9/22; D06C 3/00; D06C 3/10

See application file for complete search history.

(56) References Cited

U.S. PATENT DOCUMENTS

| | | | | | |
|---|---|---|---|---|---|
| 352,769 | A | | 11/1886 | Moon et al. | |
| 374,623 | A | | 12/1887 | Pease | |
| 570,940 | A | | 11/1896 | Maynard | |
| 929,583 | A | * | 7/1909 | Gibbs | |
| 935,841 | A | * | 10/1909 | Fife | D05C 1/04 38/102.2 |
| 1,221,123 | A | * | 4/1917 | Westhaver | D05C 1/04 38/102.2 |
| 1,242,972 | A | | 10/1917 | Pettit | |
| 1,412,019 | A | | 4/1922 | Ploch | |
| 1,944,690 | A | * | 1/1934 | Karle | D05C 1/04 112/121 |
| 2,957,269 | A | * | 10/1960 | Nohl | D05C 1/04 38/102.2 |
| 4,128,356 | A | * | 12/1978 | Carlisle | F16B 7/0413 402/26 |
| 4,411,208 | A | * | 10/1983 | Nishida | D05C 9/04 112/102.5 |
| 4,422,250 | A | | 12/1983 | Golan | |

(Continued)

*Primary Examiner* — Ismael Izaguirre

(74) *Attorney, Agent, or Firm* — Dominic A. Frisina

(57) ABSTRACT

An improved embroidery hoop is provided. The hoop includes a closed outer loop having a receiving groove in an inner perimeter surface. The receiving groove cooperates with and receives a retaining loop according to a predetermined fit appropriate for holding a fabric workpiece. The outer loop is rigid while the inner retaining loop is sufficiently flexible to be fitted by hand in the receiving groove. The embroidery hoop may optionally include a pull tab for assisting a user in removing the retaining loop from the receiving groove. Moreover, the outer perimeter of the outer loop has a geometry that is arbitrary and independent of the geometry of the receiving groove and retaining loop. Accordingly, the outer loop may comprise fanciful designs.

20 Claims, 6 Drawing Sheets

(56) References Cited

U.S. PATENT DOCUMENTS

| | | | | | |
|---|---|---|---|---|---|
| 4,485,574 | A | * | 12/1984 | Bennetot | D05C 9/04 112/103 |
| 4,726,130 | A | * | 2/1988 | Bussard | D05C 1/04 38/102.2 |
| 5,303,486 | A | | 4/1994 | Dell | |
| 5,555,653 | A | | 9/1996 | Morgan | |
| 5,722,191 | A | * | 3/1998 | Morgan | D05C 1/04 38/102.2 |
| 6,154,991 | A | | 12/2000 | Duncan et al. | |
| 6,901,870 | B2 | * | 6/2005 | Eklof | D05C 9/04 112/103 |

* cited by examiner

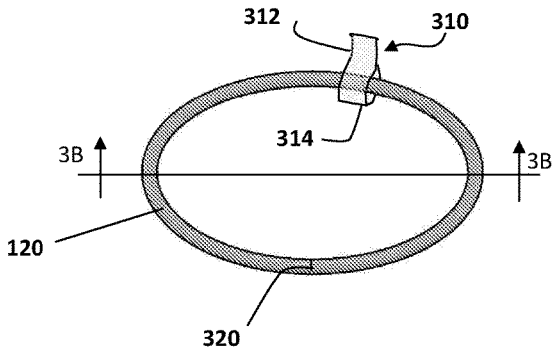
FIG. 3A
FIG. 3B
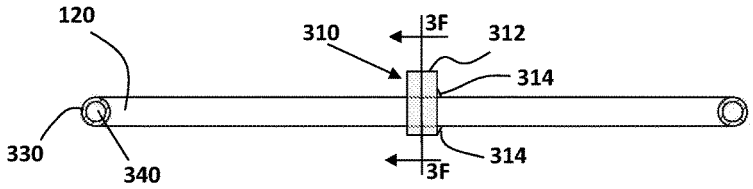
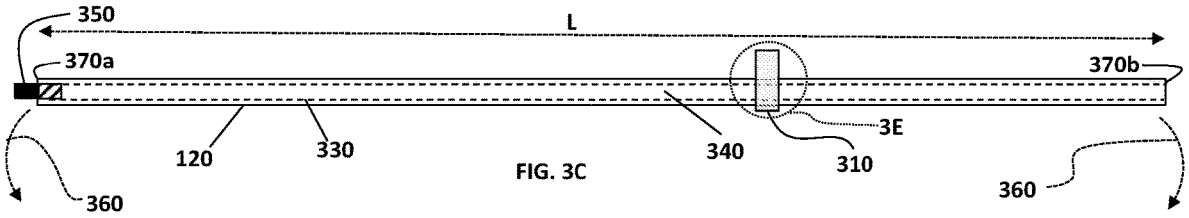
FIG. 3C
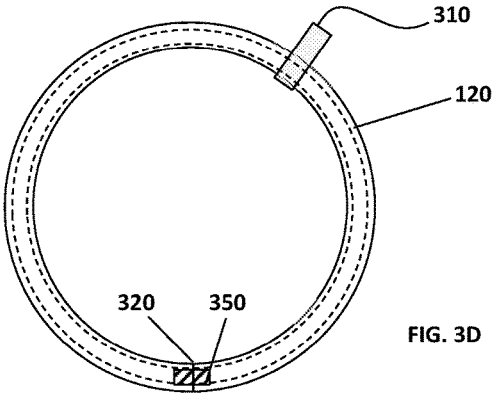
FIG. 3D

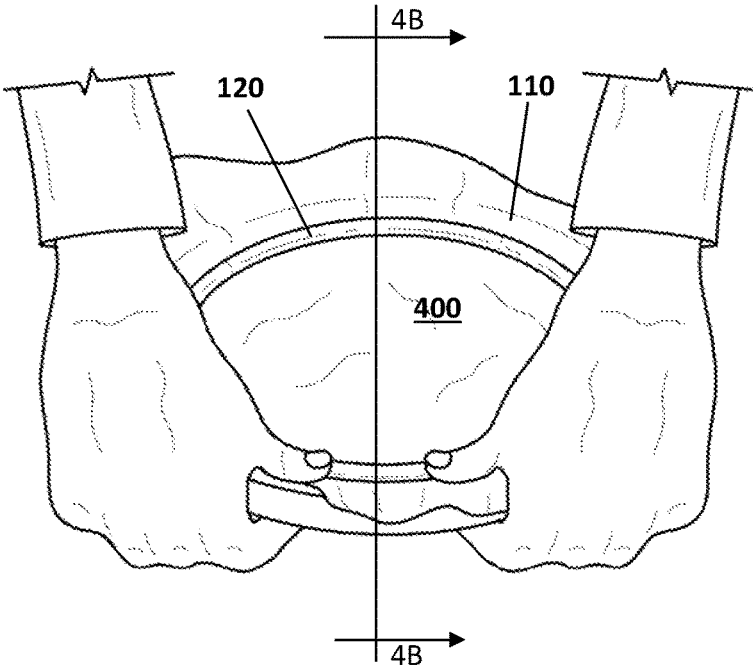
FIG. 4A
FIG. 4B
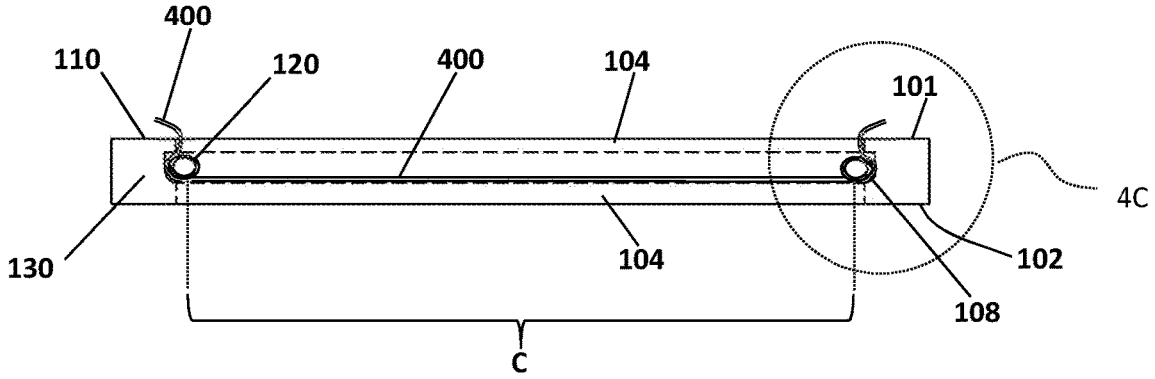
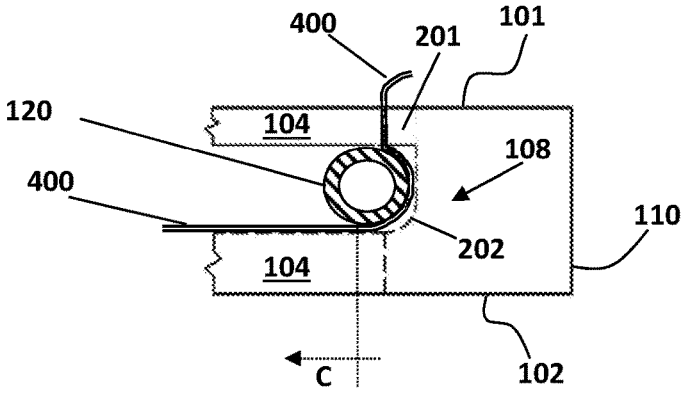
FIG. 4C

EMBROIDERY WORKPIECE HOLDING DEVICE

I. BACKGROUND OF THE INVENTION

A. Field of Invention

The invention generally relates to the field of holding fabrics during embroidery processes.

B. Description of the Related Art

The practice of embroidery and the use of embroidery hoops has been known for many years. Generally, a cloth workpiece is held taut by an annular hoop so that an embroiderer can readily access both sides of the cloth and accurately place stitches therein according to a predetermined pattern. Many embroidery hoop designs are known in the art, which take varying approaches to affixing a cloth workpiece to a hoop. For instance, a device by Golan (U.S. Pat. No. 4,422,250) describes a semi-circular spring-loaded member that fits securely in an interiorly grooved surface. Golan's device requires a restraining means to assist a user in circumferentially compressing the relatively stiff steel spring-loaded member. In contrast, Moon et al. (U.S. Pat. No. 352,769) uses a groove in the outer circumference of a ring to receive a spiral wire elastic band. The cloth workpiece is held in circumferential compression between the groove and the elastic band.

What is missing is an embroidery hoop capable of exerting a circumferential compression on a cloth workpiece, sufficient to fix the workpiece in place, with a simple annular ring and without the need for added compressing or tensioning structures. Some embodiments of the present invention may provide one or more benefits or advantages over the prior art.

II. SUMMARY OF THE INVENTION

Some embodiments may relate to an embroidery hoop, comprising an outer loop. The outer loop may define a closed loop and may have an inner perimeter surface and an outer perimeter surface. The outer loop may also have a front face and a rear face, and may be rigid. The hoop may also include a receiving groove defined by a closed-loop recess in the inner perimeter surface. The receiving groove may have a cross-sectional shape of predetermined depth and width. The hoop may further include an inner retaining loop dimensioned to mate with the receiving groove of the outer loop in a predetermined fit. The retaining loop is substantially rigid about a longitudinal axis, and elastically flexible transverse to the longitudinal axis.

Embodiments may further comprise a pull tab in tensile communication with the inner retaining loop transverse to the longitudinal axis of the inner retainer loop.

According to some embodiments the pull tab comprises a tab portion and a loop portion, the loop portion being dimensioned to receive a section of the retaining loop.

According to some embodiments the retaining loop includes a narrowed section defining a seat receivably co-operable with the loop portion of the pull tab and dimensioned to compensate for a thickness of the loop portion of the pull tab.

According to some embodiments the retaining loop and the receiving groove compressively cooperate to hold a fabric sheet interposed therebetween.

According to some embodiments the retaining loop includes a first end and a second end that are joined, defining a seam.

According to some embodiments the retaining loop comprises a length of tubing having a predetermined wall thickness and a lumen.

Embodiments may further comprise a joining pin press fitted to the lumen at the first end and at the second end of the retaining loop.

According to some embodiments the receiving groove includes a retaining ledge extending radially inward toward a center of the outer loop from the from the front face of the outer loop.

According to some embodiments the receiving groove further comprises a curved retaining loop seat having a curvature complementary to a curvature of the retaining loop, and co-operable with the retaining ledge to fix the retaining loop in an installed position within the retaining groove.

According to some embodiments the fit between the retaining loop and the receiving groove is a transition fit or an interference fit.

According to some embodiments the outer perimeter surface of the outer loop comprises a geometry selected from circular, elliptical, triangular, rectangular, pentagonal, hexagonal, heptagonal, octagonal, nonagonal, decagonal, polygonal, complex, irregular, or arbitrary.

According to some embodiments the geometry of the outer perimeter surface is geometrically similar to a geometry of the receiving groove.

According to some embodiments the geometry of the outer perimeter surface of the outer loop is geometrically arbitrary to a geometry of the receiving groove.

According to some embodiments a geometry of the receiving groove is circular about a longitudinal axis of the receiving groove.

According to some embodiments the receiving groove comprises a geometry selected from circular, elliptical, triangular, rectangular, pentagonal, hexagonal, heptagonal, octagonal, nonagonal, decagonal, polygonal, complex, irregular, or arbitrary.

According to some embodiments a geometry of the outer perimeter surface is arbitrary and independent of the geometry of the receiving groove.

According to some embodiments the retaining loop protrudes radially inward from the receiving groove of the outer loop when the retaining loop is installed in the receiving groove.

Embodiments may relate to an embroidery hoop. The embroidery hoop may comprise an outer loop. The outer loop may define a closed loop having an inner perimeter surface and an outer perimeter surface, and having a front face and a rear face, wherein the outer loop is rigid. The hoop may further include a receiving groove defined by a closed-loop recess in the inner perimeter surface, the receiving groove having a cross-sectional shape of predetermined depth and width. The hoop may still further include an inner retaining loop dimensioned to mate with the receiving groove of the outer loop in a predetermined fit, wherein the retaining loop is substantially rigid about a longitudinal axis, and elastically flexible transverse to the longitudinal axis. Embodiments may further include a pull tab in tensile communication with the inner retaining loop transverse to the longitudinal axis of the inner retainer loop, wherein the pull tab comprises a tab portion and a loop portion, the loop portion being dimensioned to receive a section of the retaining loop, and wherein the retaining loop includes a narrowed section defining a seat receivably co-operable with the loop portion of the pull tab and dimensioned to compensate for a thickness of the loop portion of the pull tab.

According to some embodiments the geometry of the outer perimeter surface is arbitrary and independent of the geometry of the receiving groove.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein:

FIG. 3A is a perspective view of a retaining loop and pull tab with the pull tab rendered semitransparent;

FIG. 3B is a cross-sectional view of the retaining loop of FIG. 3A taken along line 3B-3B with the pull tab rendered semitransparent to show the underlying tubing structure;

FIG. 3C is a transparent view of the retaining loop of FIG. 3A such that the viewer sees into through to tubing wall revealing internal structure, and showing the retaining loop in an open-loop configuration with the ends disconnected and the tubing straightened;

FIG. 3D is a transparent plan view of the retaining loop of FIG. 3C in a closed-loop configuration;

FIG. 4A is a perspective view of an embodiment showing a workpiece being manually installed;

FIG. 4B is a cross-sectional view of an embodiment with an installed workpiece, the cross section being taken along line 4B-4B of FIG. 4A;

FIG. 4C is a closeup view of region 4C of FIG. 4B showing the embodiment cooperating with a workpiece;

IV. DETAILED DESCRIPTION OF THE INVENTION

Figure 1A:
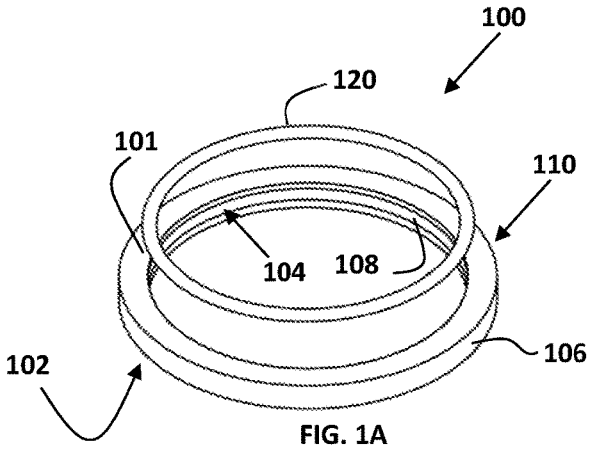
FIG. 1A is an exploded view of an embodiment.

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Embodiments include an embroidery hoop having a rigid outer loop defining an inner circumferential surface and an outer circumferential surface. The inner surface defines a receiving groove having a predetermined depth, width, and cross-sectional shape wherein the groove extends through the entire length of the inner circumferential surface. The embroidery hoop also includes an inner retaining loop dimensioned to mate with the receiving groove of the outer loop in an interference fit or transition fit. The retaining loop is rigid about its longitudinal axis, but elastically flexible transverse to the longitudinal axis. The embroidery hoop may optionally include a tab in tensile communication with the inner retaining loop, and/or outer loop, allowing a user to pull the retaining loop from the receiving groove with relative ease. The retaining loop and receiving groove are adapted to cooperate in holding a fabric sheet interposed therebetween. Contemplated embroidery hoops within the scope of the invention include outer surfaces and receiving grooves having basic geometric shapes that are independently selected from, for example and without limitation, circular, elliptical, triangular, rectangular, pentagonal, hexagonal, heptagonal, octagonal, nonagonal, decagonal, polygonal, irregular shapes, complexes of a plurality of basic and/or irregular shapes, or even fanciful shapes like the shape of a nation or state. Accordingly, the outer perimeter surface and receiving groove may define different shapes, or may define similar shapes according to the geometric definition of similar shapes, meaning differing only in scale.

Referring now to the drawings wherein the showings are for purposes of illustrating embodiments of the invention only and not for purposes of limiting the same, FIG. 1A is an exploded view of an embodiment 100 from above the front face 101 of a rigid outer loop 110. Although the illustrated embodiment has a generally circular form, it is to be understood that the invention is not limited by shape, but rather may take on any arbitrary shape provided that the outer loop 110 cooperates with an inner retaining loop 120. As used herein the term rigid is intended to be a relative term rather than an absolute term. More specifically, materials are said herein to be rigid if the amount of deformation is negligible under loads consistent with normal operating conditions.

With continuing reference to FIG. 1A, a rear face 102 of the outer loop 110 is out of view, but its general position is indicated by arrow 102. Also shown in FIG. 1A is the outer circumferential surface 106 and the inner circumferential surface 104 of the outer loop 110. While the terms inner and outer "circumferential" surface 104, 106 accurately describe the illustrated embodiment, the invention is not limited to circular shapes. In non-circular embodiments, equivalent surfaces may be referred to more generally as an inner perimeter surface and an outer perimeter surface. A circular retaining loop 120 is shown hovering above the front face 101 of the outer loop 110, illustrating the complementary shapes of a receiving groove 108 and the retaining loop 120. The receiving groove 108 is a closed-loop recess defined in the inner circumferential surface 104 having a predetermined depth, width, and cross-sectional shape dimensioned to receive the retaining loop 120. Similar to the retaining loop 120, the receiving groove 108 defines a longitudinal axis (not shown). The center-of-mass longitudinal axes of the retaining loop 120 and receiving groove 108 may or may not coincide when the retaining loop 120 is installed in the receiving groove 108. More specifically, the receiving groove 108 is sized to receive the retaining loop 110 in an interference fit or a transition fit. The person having ordinary skill in the art will appreciate that the appropriate fit will be determined by the thickness and compliance of the workpiece that the embodiment is designed to hold.

With particular regard to the fit between the receiving groove 108 and retaining loop 120, it will be readily understood by the skilled artisan that the thickness of a workpiece will affect the fit of the retaining loop 120 and receiving groove. More specifically, with no workpiece installed the fit between a retaining loop 120 and receiving groove 108 may comprise a clearance fit, but may become a transition or interference fit with a workpiece installed. With respect to the fit where a workpiece is installed, the skilled artisan will appreciate that either a transition or interference fit may be suitable depending on the desired functionality of an embodiment. For instance, embodiments that may be reused with multiple embroidery workpieces may include a retaining loop that is removable by hand when an embroidery workpiece is installed. Transition fits may be more suitable for such applications. Alternatively, embodiments that are intended for permanent installation of a workpiece may require an interference fit.

Figure 1B:
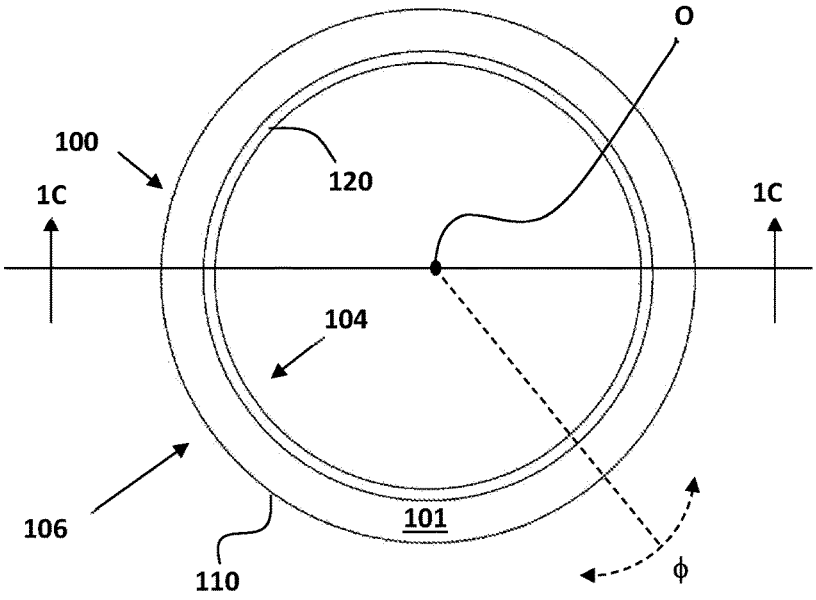
FIG. 1B is a plan view of the embodiment of FIG. 1A.

FIG. 1B shows the embodiment 100 of FIG. 1A in a plan view. The retaining loop 120 is shown installed in the receiving groove 108 of the outer loop 110. Although the retaining loop 120 is shown protruding radially inward from the outer loop member 110, the person having ordinary skill in the art will understand that this is not a limitation of the invention; however, allowing for some degree of protrusion may have certain advantages especially with respect to making the retaining loop more accessible for removal by hand. The ordinarily skilled artisan will readily appreciate that it is generally easier to grip a loop 120 protruding from a receiving groove 108 than one recessed within a receiving groove. Thus, protruding retaining loops 120 may be preferable in embodiments designed for removable workpieces, as opposed to permanently installed workpiece, provided the retaining loop does not interfere with the workpiece and is not too stiff for removal by hand. As used here, "by hand" includes removing the retaining loop with a pull-tab member, or other member, comprising the embodiment and functioning to mechanically assist a user to remove the retaining loop. Such members will be described further herein.

Angle $\phi$ of FIG. 1B refers to angular position about a central origin O. Although, the illustrated embodiment is circular, angle $\phi$ is equally applicable to non-circular arbitrarily shaped embodiments.

Figure 1C:
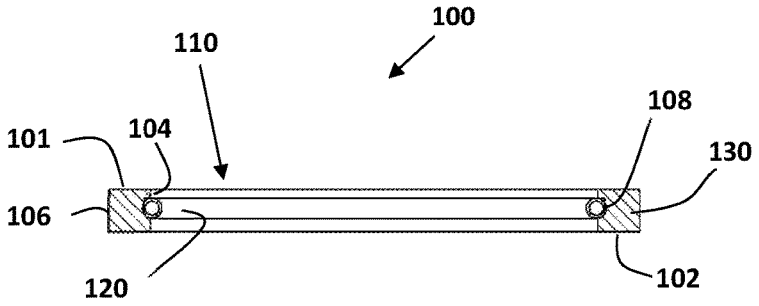
FIG. 1C is a cross-sectional view of the embodiment of FIG. 1B taken along line 1C-1C.

FIG. 1C is a cross-sectional view of the embodiment of FIG. 1A taken along line 1C-1C and illustrates the cooperation between the retaining loop 120 and receiving groove 108. In this view, the front face 101 of the outer loop 110 of the embodiment is oriented upward and the rear face 102 is oriented downward. The cross-sectional shape 130 of the outer loop 110 is shown in FIG. 1C as generally rectangular 130, meaning rectangular except for the indentation made by the receiving groove 108. Moreover, when viewed in combination with FIG. 1B it is readily apparent that the cross-sectional area 130 is uniformly swept through $\phi$=360 degrees to form concentric inner 104 and outer 106 circumferential surfaces. Importantly, it is to be understood that this is merely a feature of the illustrated embodiment and not a limitation of the invention.

More specifically, the cross-sectional area 130 may vary arbitrarily in shape from one embodiment to another, and may further vary arbitrarily within a single embodiment, as a function of angular position $\phi$. Such variability is limited however, by the fact that it must allow for a receiving groove 108. Accordingly, since the cross-sectional area 130 may vary arbitrarily as a function of $\phi$, embodiments may take on arbitrary shapes, as will be described in more detail in discussing FIGS. 5A, 5B, and 5C.

Figure 2A:
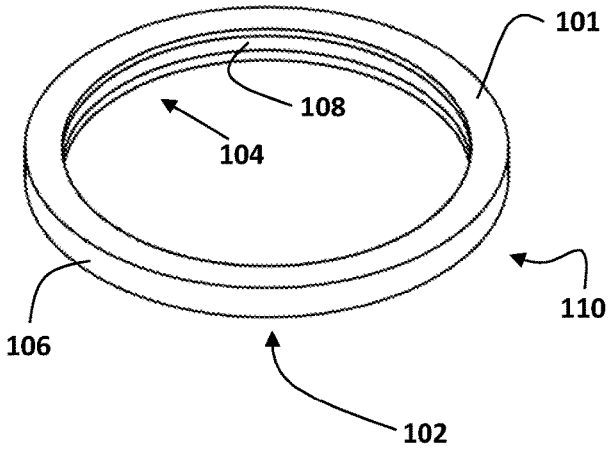
FIG. 2A is a perspective view of the outer loop of FIG. 1A.
Figure 2B:
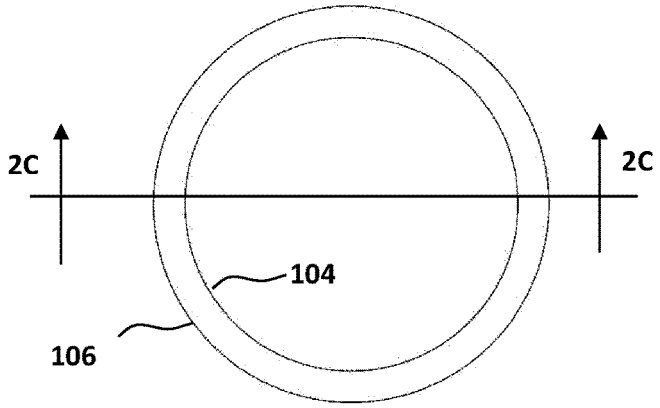
FIG. 2B is a plan view of the outer loop of FIG. 2A.
Figure 2C:
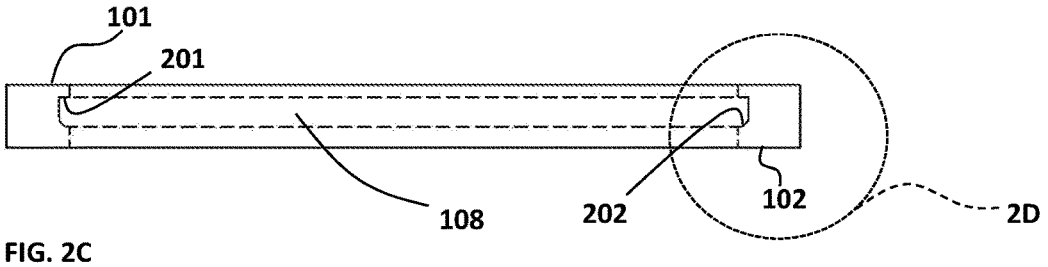
FIG. 2C is a cross-sectional view of the outer loop of FIG. 2B taken along line 2C-2C.
Figure 2D:
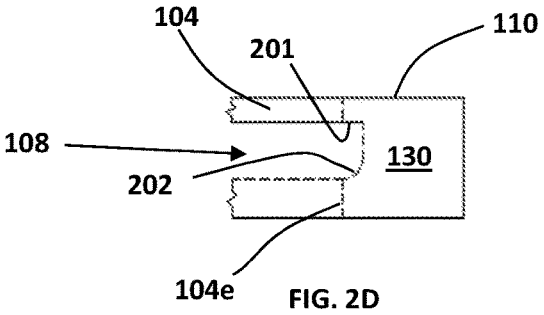
FIG. 2D is a closeup view of the region of the outer loop contained within circle 2D of FIG. 2C.
Figure 2E:
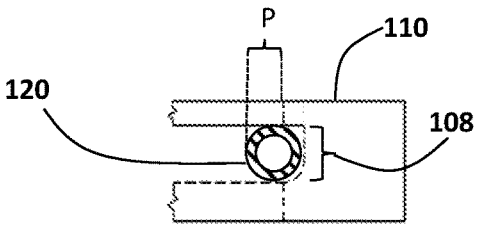
FIG. 2E is the region illustrated in FIG. 2D additionally showing cooperation of the receiving groove with a retaining loop.

FIGS. 2A-2D illustrate certain structural details of an outer loop 110 including the cross-sectional geometry of a retaining groove. The gross form of an outer loop 110 according to a circular embodiment of the invention is shown in FIG. 2A including inner and outer circumferential surfaces 104, 106 a receiving groove 108, and front and rear faces 101, 102. FIG. 2B shows the same embodiment as FIG. 2A in plan view. FIG. 2C is a cross-sectional view of the embodiment of FIG. 2B taken along line 2C-2C. The receiving groove 108 of this embodiment is asymmetric with a gentle curved surface 202 near the rear face 102, and a sharp ledge 201 near the front face 101. The receiving groove 108 is defined by the combination of the sharp retaining ledge 201 and the curved retaining loop seat 202. As shown in FIGS. 2C and 2D, the seat 202 is the entire surface bounded by the retaining ledge 201 and the inner circumferential surface 104. The seat 202 roughly matches the curvature of, and is matable with, a retaining loop 120, as is more clearly shown in FIG. 2E. By matching or roughly matching the contours of the seat 202 and retaining loop 120, the contact area between the embodiment 100 and a workpiece is increased, thereby providing a more secure grip on the workpiece. Circle 2D indicates the area shown in closeup in FIG. 2D.

In closeup view FIG. 2D, structures of the retaining groove 108 of the embodiment are more readily visible, particularly the curved seat 202 and the sharp retaining ledge 201 of the retaining groove 108. Structure 104*e* indicates a boundary between the inner circumferential surface 104 and the cross-sectional area of the outer loop 130. Continuing to FIG. 2E, the outer loop 110 is shown receiving an inner loop 120 in the receiving groove 108. The retaining loop 120 is shown protruding a distance P from the receiving groove 108. Moreover, it will be clear to the person having ordinary skill in the art that if structures 201 and 202 remain constant, cross-sectional area 130 can vary arbitrarily without affecting the retaining loop 120 in any way.

FIG. 3A illustrates a circular retaining loop 120 according to an embodiment of the invention having a circular receiving groove 108. The person having ordinary skill in the art will appreciate that the receiving groove 108, and therefore the retaining loop 120, need not be limited by shape longitudinally or cross-sectionally, except that the receiving groove 108 and retaining loop 120 should be co-operable and thus substantially complementary in shape. The illustrated retaining loop 120 includes a seam or break point 320 where ends of the retaining loop 120 meet.

Regardless of the use of the word "seam" herein in reference to structure 320, the ends of the retaining loop 120 may or may not be joined. According to the illustrated embodiment, the retaining loop may comprise a length of commercially available one quarter or three eighths inch outer diameter (OD) polyolefin tubing. The ends 370*a*, 370*b* (see FIG. 3C) of the tubing may be joined according to conventional methods. For instance, and without limitation, the ends may be joined by press fitting them to either end of a pin, or by welding or melting the ends together. Alternatively, the retaining loop 120 may be molded in a closed-loop form thus obviating the need for forming a seam or joining ends. Still further, the ends of the loop 120 may be left free and un-joined in a linear tube form without interfering with the inner loop's 120 ability to cooperate with a receiving groove 108.

With continuing regard to FIG. 3A, the embodiment is shown to include an optional pull tab 310. The pull tab 310 provides a user with assistance in removing the inner retaining loop 120 from the receiving groove 108. This may be particularly helpful in embodiments where the inner loop 120, outer loop 110, and workpiece cooperate to form a rather tight fit, which may be particularly challenging to remove for elderly users, or users who have a grip strength significantly less than that of an average user. The person having ordinary skill in the art will understand whether a pull tab 310 is advantageous for any given embodiment.

As shown in FIG. 3A, a pull tab 310 may include a tab portion 312 and a loop portion 314. The tab 312 is may be gripped by a user, for instance, between the thumb and forefinger, and pulled by the user. The loop 314 transfers the pulling force from the tab 312 to the inner loop 120. The pull tab 310 is shown in a very loose fit with the inner loop 120 primarily to illustrate the structure of the loop 312. However, pull tabs 310 may fit tightly around the inner loop 120, and in some embodiments the pull tab 310 may be an integral part of the inner loop 120. For instance, the pull tab 310 and inner retaining loop 120 may be made from a common mold.

In embodiments where the pull tab 310 is not an integral part of the inner loop 120, but rather is a separate part, the inner loop 120 may include a narrowed section functioning as a seat for loop 314 of the pull tab 310. Such a narrowing of the inner loop 120 provides the advantage of fixing the location of the pull tab, and also may be dimensioned to compensate for the thickness of the pull tab 310. More specifically, the skilled artisan will appreciate that the loop 314 must have a thickness. Accordingly, the fit between the inner loop 120, outer loop 110, workpiece will be tighter at the location of the tab 310 than at any other point about the perimeter of the inner loop 120. While this may be inconsequential in connection with thinner workpieces, it may render an embodiment inoperable in connection with thicker workpieces. Accordingly, compensating for the thickness of the pull tab 310 may be preferable.

FIG. 3B is a cross-sectional view of the retaining loop 120 of FIG. 3A taken along line 3B-3B. In this view the structure of the retaining loop is shown to be tubing with a wall 330, having a predetermined thickness, enclosing a lumen 340. The pull tab 310 is also shown with the tab portion 312 directed upward and the loop wrapping around the inner loop 120. FIG. 3C shows the retaining loop 120 in a straightened configuration. A longitudinal axis L is shown running end to end. A joining pin 350 is shown press-fitted into a first end 370*a* of the retaining loop 120. Arrows 360 show the bending motion required to bring the first and second ends 370*a*, 370*b* together to form seam 320. FIG. 3D shows the retaining loop 120 in a circular configuration resulting from bringing the first and second ends 370*a*, 370*b* together as shown in FIG. 3C in a press fit with joining pin 350. The embodiment is also illustrated with a pull tab 310. The illustrated configuration is operatively compatible with the receiving groove 108 of outer loop 110.

Figure 3E:
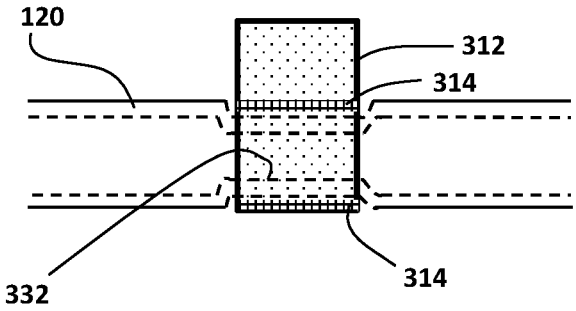
FIG. 3E is a closeup of the view shown in FIG. 3C at circle 3E.

FIG. 3E is a closeup view of the transparent view of FIG. 3C at circle 3E. The inner loop 120 includes a narrowed length comprising a seat 332 receiving the loop 314 of the pull tab 310. The top and bottom extremes of the loop 314 are shown in hatched lines to indicate that the thickness of the loop 314 material matches the outer diameter of the main portion of the inner loop 120 due to the narrowing at 332. Thus, the recessed seat 332 compensates for the thickness of the loop 314 of the pull tab 310. The tab portion 312 of the pull tab 310 is shown directed upward.

Figure 3F:
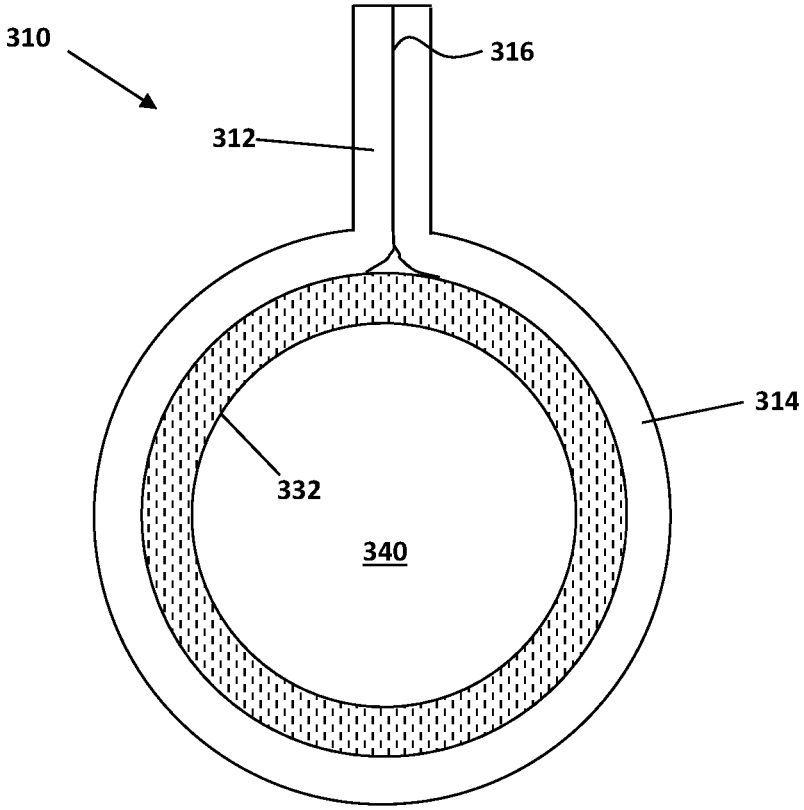
FIG. 3F is a cross section of the view shown in view shown in FIG. 3B taken along line 3F-3F.

FIG. 3F is a cross-sectional view of the retaining loop 120 of FIG. 3B taken along line 3F-3F, showing the structure of the pull tab 310 in greater detail. The pull tab 310 illustrated here is a monolithic piece of fabric wrapped around the seat 332 of the inner loop 120 to form a loop 314, with the ends being bonded according to conventional means at seam 316 to form the tab portion 312. The hollow lumen 340 is also visible. As previously noted, the invention is not limited to this specific pull tab structure.

While a variety of materials may be appropriate for fabricating a retaining loop, the person having ordinary skill in the art would be enabled by the present specification to select materials according to non-obvious parameters described herein. According to a first parameter, suitable materials are sufficiently rigid about the longitudinal axis L (FIG. 3C) of the loop so that the loop may cooperate with the receiving groove to hold a workpiece in compression. However, suitable materials are also sufficiently compliant transverse to the longitudinal axis so that the retaining loop may be elastically deformed by hand to manually fit it into the receiving groove. The ordinarily skilled artisan will understand that transverse flexion includes a component of tensile flexion. Accordingly, suitable materials are said to be substantially rigid in the longitudinal direction because under normal operating conditions they exhibit negligible tensile stretching except for the component of tensile stretch that comprises transverse flexion.

Generally, a polyolefin tubing will be more suitable than most common metals and alloys, for instance. This is because polyolefins have room-temperature flexural moduli about two orders of magnitude less than common metals according to well-known standards such as ASTM test D790. Accordingly, retaining loops 120 can be made from much larger OD tubing, and greater wall thicknesses 330, than common metals, making them easier to grip while still being easily deformed and manipulated by hand without the need for added structures to assist the user in bending the retaining loop 120 and fitting it into the receiving groove 108. The person having ordinary skill in the art will readily understand that, in addition to material choice, the stiffness of the retaining loop 120 can be adjusted as a function of wall thickness 330. Accordingly, retaining loops may have a predetermined wall thickness providing a desired stiffness.

FIG. 4A illustrates a circular embodiment being manually fitted with a workpiece. The embodiment is the same as that previously shown in the preceding FIGS. 1A through 3D. A workpiece 400 is shown draped over the outer loop 110. An inner retaining loop 120 is shown, over the workpiece, being manually fitted by hand into the receiving groove 108 of the outer loop 110. The workpiece 400 is thus being fixed between the outer loop 110 and the inner loop 120.

FIG. 4B is a cross-sectional view of the embodiment shown in FIG. 4A taken along line 4B-4B. The workpiece 400 is shown in relation to the outer and inner loops 110, 120. Particularly, it is compressed between the outer and inner loops 110, 120 in the receiving groove 108. The workpiece 400 is shown stretched taut in a central region C of an inside diameter of the embodiment. Accordingly, a user can access the workpiece 400 from both the front face 101 and the rear face 102. Excess fabric of the workpiece 400 is shown protruding from the receiving groove 108. Circle 4C indicates a region of FIG. 4B shown in a magnified view in FIG. 4C.

FIG. 4C shows in more detail the workpiece 400 compressed between the outer loop 110 and inner loop 120 in the receiving groove 108. Particularly, the workpiece 400 is shown compressed against the curved retaining loop seat 202, and the retaining ledge 201. Excess fabric protrudes from the retaining ledge 201 while taut fabric protrudes from the retaining loop seat 202 extending into the central region C. The central region C is the area bounded by the largest diameter where the workpiece 400 contacts neither the outer loop 110 nor the inner loop 120. The person having ordinary skill in the art will readily understand that FIG. 4C illustrates the outermost boundary of the central region C as a point because this is a cross-sectional view, but that the boundary is actually circular. The person having ordinary skill in the art will also readily appreciate that the invention is not limited to circular receiving grooves 108 and circular retaining loops 120, and that a circular shape has been selected arbitrarily as an illustrative example.

Figure 5A:
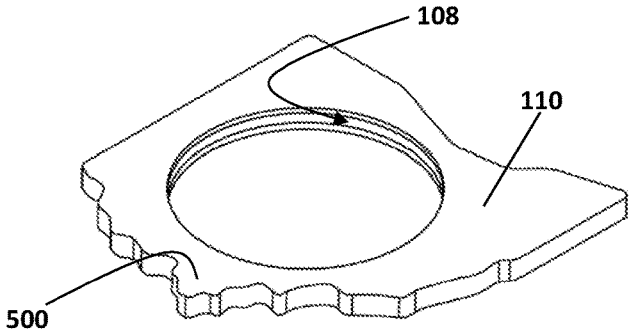
FIG. 5A is a perspective view of an embodiment having a circular inner perimeter and arbitrarily shaped outer perimeter.
Figure 5B:
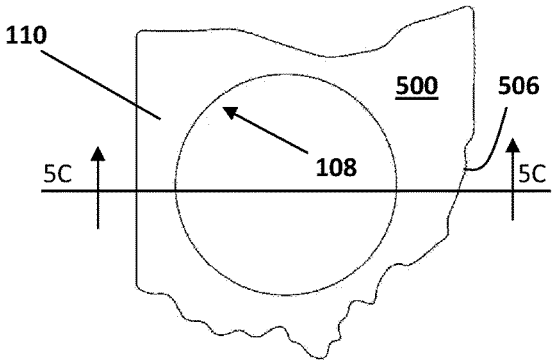
FIG. 5B is a plan view of the embodiment of FIG. 5A.
Figure 5C:
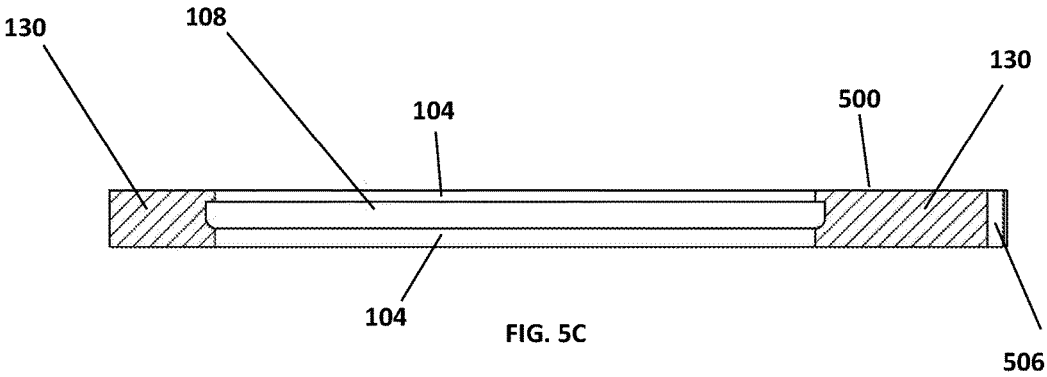
FIG. 5C is a cross-sectional view of the embodiment of FIG. 5B taken along line 5C-5C.

FIGS. 5A-5C illustrate an embodiment where the region 500 of the outer loop 110 disposed radially outward from the arbitrarily circular receiving groove 108 comprises a fanciful geometry that differs from that of the receiving groove 108. Specifically, the outer loop 110 forms the shape of the state of Ohio, while the receiving groove 108 is circular. FIG. 5B shows the embodiment of FIG. 5A in plan view, further illustrating the circular receiving groove 108 and Ohio-shaped region 500 of the outer loop 110. FIG. 5B also indicates the outer perimeter surface 506.

FIG. 5C is a cross-sectional view of the embodiment of FIG. 5B taken along line 5C-5C. The cross-sectional area 130 of the outer loop 110 is shown to be asymmetric at two diametrically opposed regions of the cross-sectional view, which is the necessary consequence of the selected shape 500. Furthermore, a portion of the outer perimeter surface 506 is visible. The reason why this is visible is evident from where the cross section is taken in FIG. 5B. Particularly, on the right side of the figure the portion of the outer perimeter surface 506 forward of line 5C-5C extends farther outward radially than the cross-sectional area 130. Conversely, on the left side of the figure, the portion of the outer perimeter surface 506 forward of line 5C-5C is uniformly straight in parallel with the view.

The person having ordinary skill in the art will readily appreciate that the outer perimeter surface 506 is analogous to the outer circumferential surface 106 of circular embodiments, differing only in shape. The receiving groove 108 of the illustrated embodiment is interchangeable with that of the previously illustrated embodiments (FIGS. 1A through 4C), although it is to be understood that this is not a requirement of the invention. The receiving groove 108 may take on any suitable shape.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

The following list shows the correlation between the various reference numerals used in the appended drawings, and the elements of the drawings that they represent. This list is provided only for convenience and is not intended to be limiting in any way. Abbreviated, shortened, or otherwise somewhat different wording may be used herein to describe the same structures or drawing elements without obscuring their meaning to the person having ordinary skill in the art.

$\phi$ angular position about the circumference of the outer loop
O polar origin
P protrusion
L Longitudinal Axis
C Central region
100 circular outer loop embodiment
101 front face of the outer loop
102 rear face of the outer loop
104 inner circumferential surface of the outer loop
104*e* a cross-section boundary between 104 and 130
106 outer circumferential surface of the outer loop
108 receiving groove
110 outer loop
120 inner retaining loop
130 cross-sectional area of the outer loop
201 sharp retaining ledge
202 curved retaining loop seat
310 pull tab
312 tab portion of the pull tab
314 loop portion of the pull tab
316 tab seam
320 retaining loop seam
330 wall thickness of retaining loop
332 pull tab loop seat
340 lumen of the retaining loop
350 joining pin
360 arrows showing bending motion
370*a* first end of the retaining loop
370*b* second end of the retaining loop
400 workpiece
500 region of the outer loop 110 radially outward from the receiving groove
506 outer perimeter surface of the outer loop

We claim:

1. An embroidery hoop, comprising:

an outer loop defining a closed loop having an inner perimeter surface and an outer perimeter surface, and having a front face and a rear face, wherein the outer loop is rigid;

a receiving groove defined by a closed-loop recess in the inner perimeter surface, the receiving groove having a cross-sectional shape of predetermined depth and width;

an inner retaining loop dimensioned to mate with the receiving groove of the outer loop in a predetermined fit, wherein the retaining loop is substantially rigid about a longitudinal axis, and elastically flexible transverse to the longitudinal axis; and a pull tab in tensile communication with the inner retaining loop transverse to the longitudinal axis of the inner retainer loop.

2. The embroidery hoop of claim 1, wherein the pull tab comprises a tab portion and a loop portion, the loop portion being dimensioned to receive a section of the retaining loop.

3. The embroidery hoop of claim 2, wherein the retaining loop includes a narrowed section defining a seat receivably co-operable with the loop portion of the pull tab and dimensioned to compensate for a thickness of the loop portion of the pull tab.

4. The embroidery hoop of claim 1, wherein the retaining loop and the receiving groove compressively cooperate to hold a fabric sheet interposed therebetween.

5. The embroidery hoop of claim 1, wherein the receiving groove includes a retaining ledge extending radially inward toward a center of the outer loop from the from the front face of the outer loop.

6. The embroidery hoop of claim 5, wherein the receiving groove further comprises a curved retaining loop seat having a curvature complementary to a curvature of the retaining loop, and co-operable with the retaining ledge to fix the retaining loop in an installed position within the retaining groove.

7. The embroidery hoop of claim 6, wherein the fit between the retaining loop and the receiving groove is a transition fit or an interference fit.

8. The embroidery hoop of claim 1, wherein the outer perimeter surface of the outer loop comprises an arbitrary geometry.

9. The embroidery hoop of claim 8, wherein the geometry of the outer perimeter surface is geometrically similar to a geometry of the receiving groove.

10. The embroidery hoop of claim 8, wherein the geometry of the outer perimeter surface of the outer loop is geometrically arbitrary to a geometry of the receiving groove.

11. The embroidery hoop of claim 1, wherein a geometry of the receiving groove is circular about a longitudinal axis of the receiving groove.

12. The embroidery hoop of claim 1, wherein the receiving groove comprises an arbitrary geometry.

13. The embroidery hoop of claim 12, wherein a geometry of the outer perimeter surface is arbitrary and independent of the geometry of the receiving groove.

14. The embroidery hoop of claim 1, wherein the retaining loop protrudes radially inward from the receiving groove of the outer loop when the retaining loop is installed in the receiving groove.

15. The embroidery hoop of claim 1, wherein the retaining loop comprises a length of tubing having a predetermined wall thickness and a lumen.

16. An embroidery hoop, comprising:

a outer loop defining a closed loop having an inner perimeter surface and an outer perimeter surface, and having a front face and a rear face, wherein the outer loop is rigid;

a receiving groove defined by a closed-loop recess in the inner perimeter surface, the receiving groove having a cross-sectional shape of predetermined depth and width;

an inner retaining loop dimensioned to mate with the receiving groove of the outer loop in a predetermined fit, wherein the retaining loop is substantially rigid about a longitudinal axis, and elastically flexible transverse to the longitudinal axis; and a pull tab in tensile communication with the inner retaining loop transverse to the longitudinal axis of the inner retainer loop, wherein the pull tab comprises a tab portion and a loop portion, the loop portion being dimensioned to receive a section of the retaining loop, and wherein the retaining loop includes a narrowed section defining a seat receivably co-operable with the loop portion of the pull tab and dimensioned to compensate for a thickness of the loop portion of the pull tab.

17. The embroidery hoop of claim 16, wherein the geometry of the outer perimeter surface is arbitrary and independent of the geometry of the receiving groove.

18. An embroidery hoop, comprising:

an outer loop defining a closed loop having an inner perimeter surface and an outer perimeter surface, and having a front face and a rear face, wherein the outer loop is rigid;

a receiving groove defined by a closed-loop recess in the inner perimeter surface, the receiving groove having a cross-sectional shape of predetermined depth and width; and an inner retaining loop dimensioned to mate with the receiving groove of the outer loop in a predetermined fit, wherein the retaining loop is substantially rigid about a longitudinal axis, and elastically flexible transverse to the longitudinal axis, and wherein the retaining loop includes a first end and a second end that are joined, defining a seam.

19. The embroidery hoop of claim 18, wherein the retaining loop comprises a length of tubing having a predetermined wall thickness and a lumen.

20. The embroidery hoop of claim 19, further comprising a joining pin press fitted to the lumen at the first end and at the second end of the retaining loop.

* * * * *